US005111885A

United States Patent [19]

Umphries

[11] Patent Number: 5,111,885

[45] Date of Patent: May 12, 1992

[54] DECENTRALIZED CASING HOLE PUNCHER

[75] Inventor: Donald V. Umphries, New Iberia, La.

[73] Assignee: Directional Wireline Service, Inc., Homa, La.

[21] Appl. No.: 598,932

[22] Filed: Oct. 17, 1990

[51] Int. Cl.[5] ..... E21B 43/117

[52] U.S. Cl. ..... 166/297; 166/55; 175/4.52

[58] Field of Search ..... 166/297, 55, 55.1, 241; 175/4.51, 4.52, 4.6; 102/321, 319

[56] References Cited

U.S. PATENT DOCUMENTS

| | | | |
|---|---|---|---|
| 2,690,123 | 9/1954 | Kanady | 175/4.52 |
| 2,749,841 | 6/1956 | Jones | 175/4.52 |
| 2,760,435 | 8/1956 | Jones | 175/4.52 |
| 3,011,550 | 12/1961 | Kenneday . | |
| 3,181,608 | 5/1965 | Palmer | 175/4.52 |
| 3,280,913 | 10/1966 | Smith . | |
| 3,366,188 | 1/1968 | Hicks . | |
| 3,415,321 | 12/1968 | Venghiattis | 174/4.6 |
| 3,426,850 | 2/1969 | McDuffie, Jr. . | |
| 4,352,397 | 10/1982 | Christopher . | |
| 4,552,234 | 11/1985 | Revett . | |
| 4,688,640 | 8/1987 | Pritchard, Jr. . | |
| 4,739,839 | 4/1988 | Regalbuto et al. | 175/4.52 |
| 4,760,883 | 8/1988 | Dunn . | |

*Primary Examiner*—William P. Neuder
*Attorney, Agent, or Firm*—Matthews and Associates

[57] ABSTRACT

An explosive charge carrier is provided which is lowered into a well pipe casing. The carrier includes wear plates that slide along the inner diameter of the pipe and which are biased against the inner wall of the well pipe casing. A string of explosive charges having a density of up to six charges per foot are mounted between disks of the carrier which are separated by 12 inches. Spaced about the periphery of the separated disks are a maximum density of six strings of charges separated by 60° for 36 explosive charges. Alternately, four strings of charges may be spaced about the periphery of the separated disks at a spacing of 90° for 16 explosive charges.

10 Claims, 3 Drawing Sheets

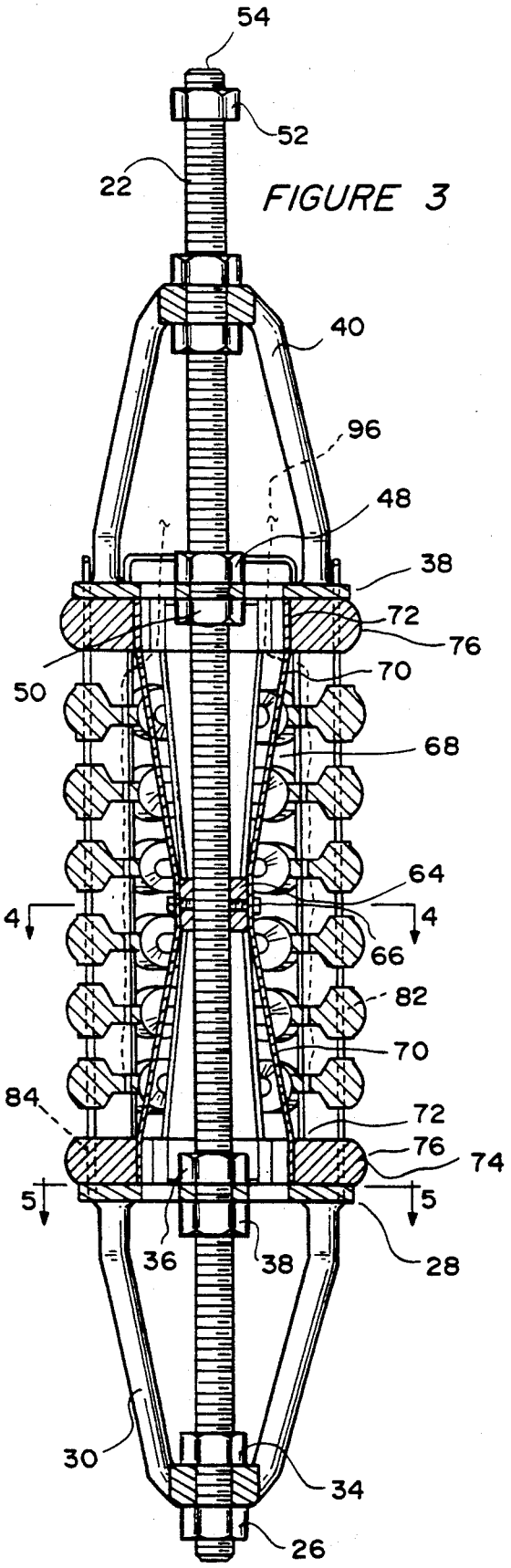
FIGURE 3
FIGURE 4
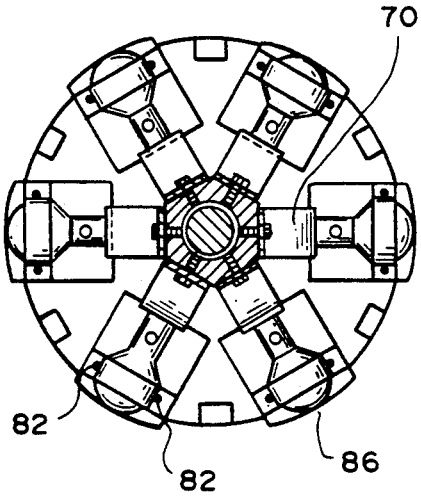
FIGURE 5
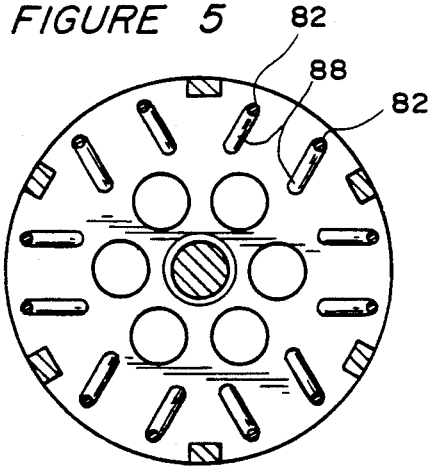
FIGURE 6
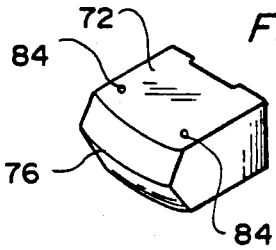

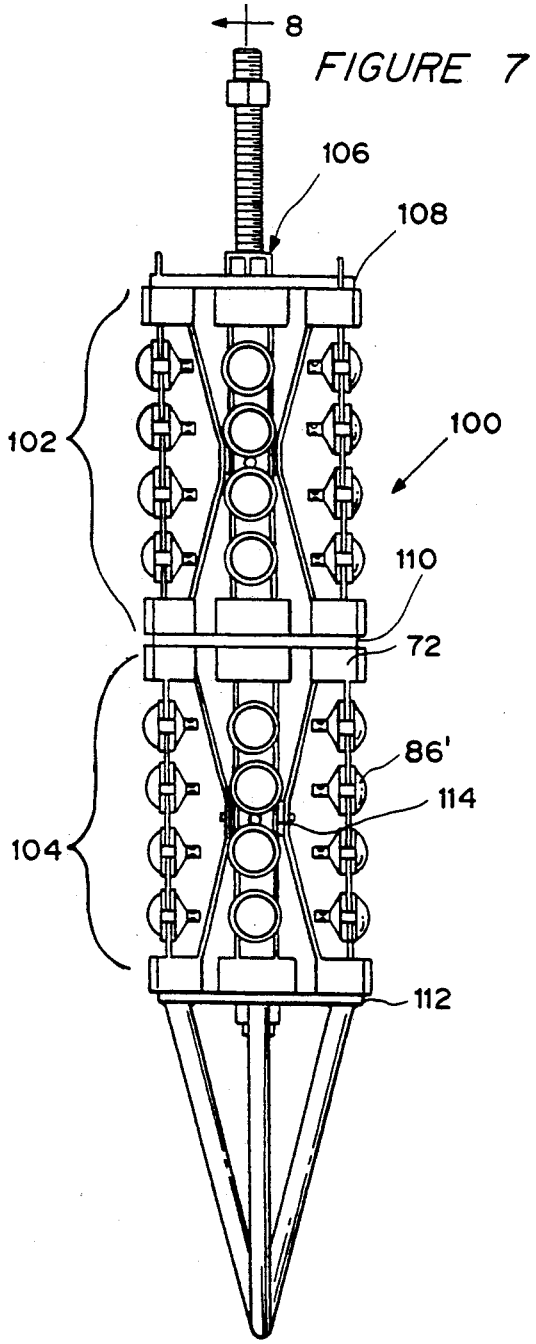
FIGURE 7
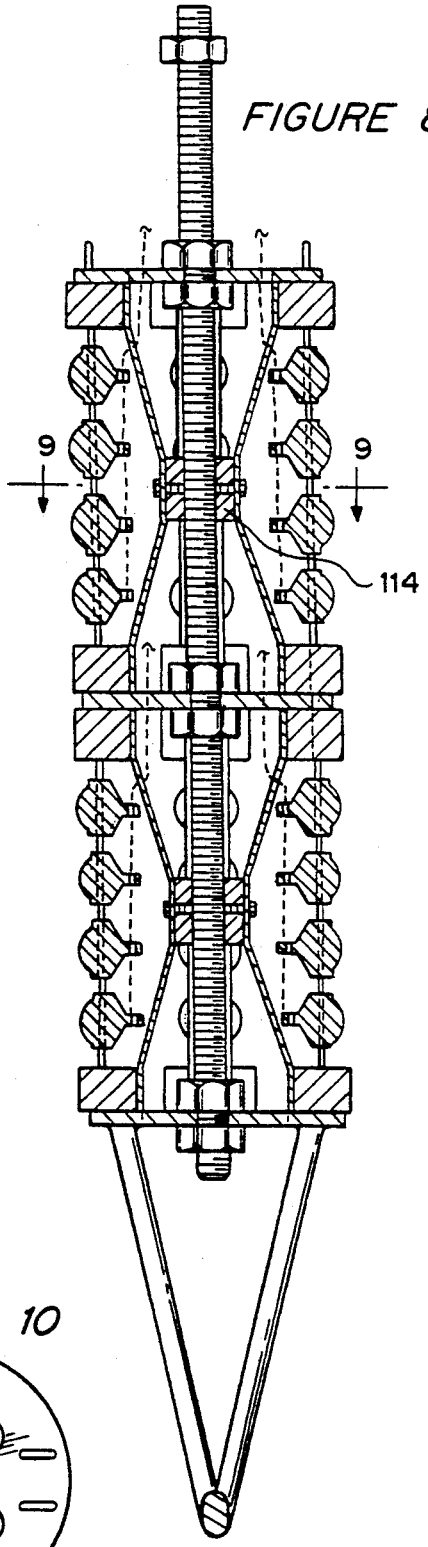
FIGURE 8
FIGURE 9
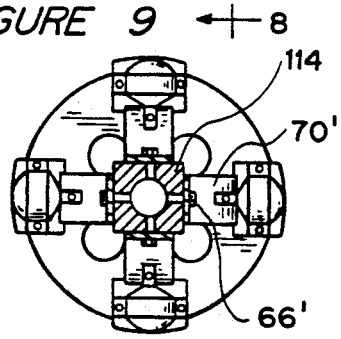
FIGURE 10
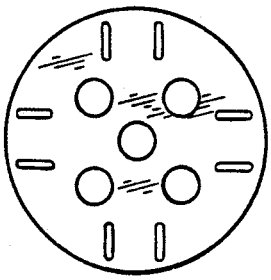

DECENTRALIZED CASING HOLE PUNCHER

FIELD OF THE INVENTION

This invention relates to a carrier onto which are mounted explosive charges so as the punch a hole in a central string of pipes in a well-type casing of an oil or gas well from within the well, over 360° of the central string of pipes.

BACKGROUND OF THE INVENTION

In the oil and gas industry, it is necessary when abandoning a well or isolating different zones of the well to seal an annular space between a central string of pipes and a surrounding protective string of pipes. To seal the annular space, it is desired to punch a hole in an innermost pipe of a series of at least two concentric strings of pipe so as to only penetrate the innermost pipe string without damaging or penetrating any other surrounding pipe strings in the well. Further, the punched pipe must not be fractured or damaged except for a limited size hole punched in a side wall.

Since it is impossible to effect a perfectly vertical well bore, there is always some degree of offset from a perfectly vertical orientation of the well bore to produce a high and a low side. Therefore, previous to the present invention, a zero degree phase gun has been lowered into a well bore and, due to the effect of gravity, the gun lays along one side (the low side) of a central casing of the well bore. A magnetizer holds the gun against the one side of the steel central casing.

The zero degree phase gun explodes a charge against the low side of the well bore.

Cement is then fed through the central casing and passed through the opening produced by the explosive charge to fill an annular gap between a central casing and a surrounding protection casing. It is important to seal the annular gap between the central casing and only the next adjacent protective pipe string so as to seal any naturally produced gases or to isolate different zones of the well bore. If an additional string of pipe is perforated by accident, it is not possible to assure that gases are being sealed by the filling with cement of the annular gap between the innermost and the most adjacent string of pipe.

Further, with a zero degree phase gun, an electrical line must be fed down through the well casing with a magnetic decentralizer, which ensures contact of the gun with a side wall of the steel well casing. As mentioned above, this contact with the well casing will be, due to gravity, on the low side of the well casing. Cement therefore poured through the well casing which is supposed to pass through the opening produced by the explosive charge into the space between the well casing and the protective casing does not usually fill this space on the high side of the well casing, leaving pockets or "channelling" through which it is possible for natural pressure to escape to the surface.

Examples of perforating charges lowered into a pipe string are disclosed in U.S. Pat. Nos. 4,688,640 to Pritchard, Jr., 4,552,234 to Revett, 3,426,850 to McDuffie, Jr., 3,280,913 to Smith, 4,352,397 to Christopher, 4,760,883 to Dunn, 3,011,550 to Kenneday, and 3,366,188 to Hicks.

The most common method of punching holes today is to use a 1 11/16 inch outside diameter steel carrier gun with a zero degree phase and a 1 11/16 inch magnetic decentralizer which is magnetized on one side. The magnet and perforating charge must face the same direction. This tool automatically finds the low side of the well bore and always perforates the casing on this low side. This results in a poor cementing of the annular space between a central string of pipe and a surrounding protection casing.

SUMMARY OF THE INVENTION

By the present invention, the disadvantages encountered in the prior art have been overcome.

An explosive charge carrier is lowered into a well pipe casing. The carrier includes wear plates that slide along the inner diameter of the pipe and which are biased against the inner wall of the well pipe casing. A string of explosive charges having a density of up to six charges per foot are mounted between disks of the carrier which are separated by 12 inches. Spaced about the periphery of the separated disks are a maximum density of six strings of charges separated by 60° for 36 explosive charges. Alternately, four strings of charge may be spaced about the periphery of the separated disks at a spacing of 90° for 16 explosive charges.

Control of the force of perforation of the perforating charges is accomplished by varying the standoff distance of the explosive charge from the casing wall to the face of the perforating charge. This can be accomplished by varying the distance between the contact surface of the wear plate when compressed radially inward and the face of the perforating charge from the inner surface of the innermost pipe string. Since the contacting surface of the wear plate will be forced against the interior surface of the well pipe casing, the distance of standoff of the perforating charge from the inner wall of the well pipe casing can be determined prior to entry of the perforating charge carrier into a well pipe casing.

Further, by controlling the spacing between the interior of the well pipe casing and the face of the penetrating charge, it is possible, when desired, to penetrate two strings of casings of, for example, 7 ⅝ inches in diameter and 9 ⅝ inches in diameter without penetrating a concentric third string having a diameter of 13 ⅜ inches. This is achieved by locating the explosive charge approximately one inch from the inner surface of the innermost pipe string.

It is therefore an object of the present invention to provide an explosive charge carrier having a density of four strings of explosive charges with the capacity of four perforating charges per foot spaced about the periphery of an inner wall of a well pipe casing.

It is another object of the present invention to provide an explosive charge carrier having a density of four strings of explosive charges with the capacity of four perforating charges per foot spaced about the periphery of an inner wall of a well pipe casing where the density of charges may be increased to six strings of perforating charges per foot with up to six charges each, which may be spaced about the inner wall of a well pipe casing.

It is another object of the present invention to provide an explosive charge carrier having a density of four strings of explosive charges with the capacity of four perforating charges per foot spaced about the periphery of an inner wall of a well pipe casing where the density of charges may be increased to six strings of perforating charges per foot with up to six charges each, which may be spaced about the inner wall of a well pipe casing with the perforating charges being biased towards the inner wall of the well pipe casing.

It is yet still another object of the present invention to provide an explosive charge carrier having a density of four strings of explosive charges with the capacity of four perforating charges per foot spaced about the periphery of an inner wall of a well pipe casing where the density of charges may be increased to six strings of perforating charges per foot with up to six charges each, which may be spaced about the inner wall of a well pipe casing with the perforating charges being biased towards the inner wall of the well pipe casing with the distance between the wall of the well pipe casing and the face of the perforating charge being varied to control the extent of perforation of the well pipe casing and any surrounding protection casing.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 3 is a sectional view of the casing hole puncher.

FIG. 4 is a sectional view taken along line 4—4 of FIG. 3.

FIG. 5 is a sectional view taken along line 5—5 of FIG. 3.

FIG. 6 illustrates a wear plate.

FIG. 7 illustrates a four-way decentralized casing hole puncher.

FIG. 8 is a sectional view taken along line 8—8 of FIG. 7.

FIG. 9 is a sectional view taken along 9—9 of FIG. 8.

FIG. 10 is a plan view of a separating disk.

DETAILED DESCRIPTION OF THE PREFERRED EMBODIMENTS

Figure 1:
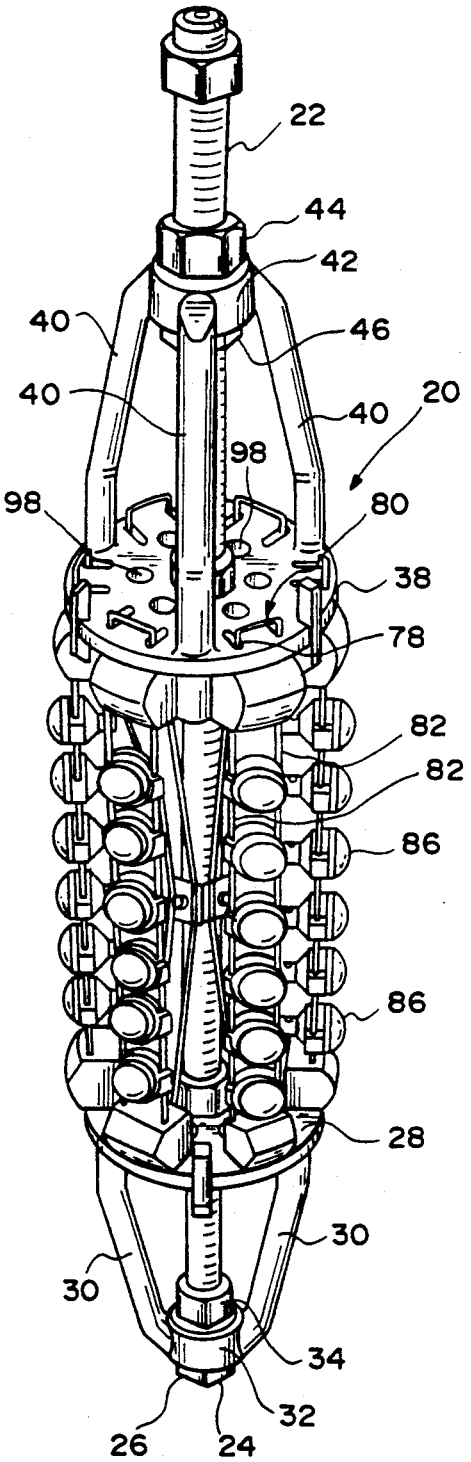
FIG. 1 is a perspective view of a six-way decentralized casing hole puncher.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 6, in particular, a six-way decentralized casing hole puncher embodying the teachings of the subject invention is generally designated as 20. With reference to its orientation in FIG. 1, the casing hole puncher comprises a central longitudinal shaft 22 which is threaded. In FIG. 1, the embodiment shown is illustrative of a device for punching of holes over a twelve-inch length. However, by repetition of the structure shown in FIG. 1, it is possible to have multiple lengths of explosive charges from one to forty feet in length.

At the lowermost end 24 of the shaft 22 is a nut 26, which acts as a stop for further downward movement of the casing hole puncher along the length of the shaft 22. A lower disk 28 includes two supporting arms 30 which are connected to a hub 32 which fits over the shaft 22. A nut 34 is located on the opposite side of the hub 32 from the nut 26. Similarly, above and below the disk 28 are securing nuts 36 and 38, respectively. The nuts 26, 34, 36 and 38 maintain the position of the disk 28 so that the plane of the disk extends perpendicular to the longitudinal axis of the shaft 22.

Spaced above the disk 28, by approximately twelve inches is an upper disk 38, having three arms 40 terminating in a hub 42 fitted over the shaft 22. Nuts 44 and 46 secure the hub on the shaft 22, while nuts 48 and 50 secure the disk 38 on the shaft so that the plane of the disk 38 extends perpendicular to the longitudinal axis of the shaft 22.

A nut 52, located at an upper end 54 of the shaft 22, is used in securing the shaft 22 to a raising and lowering assembly. The assembly 56, shown in FIG. 2, includes a mounting cap 58 which is secured to the upper end 54 of the shaft 22 and which abuts tightly against the nut 42. A ring 60 is secured to the cap 58. A steel cable 62 is crimped by wrapping 64 so as to secure the cable 62 to the ring 60.

Located between the disks 28 and 38 is a centrally located hex nut 64. In each of the six faces of the nut 64 is located a threaded bore for receipt of a set screw 66. Secured to the nut 64 by set screw 66 is an elongated spring member 68 having two arms 70 located on opposite sides of the nut 64. The arms 70 taper radially outwardly from the nut 64 and terminate in end portions 72 which extend parallel to the longitudinal axis of the shaft 22. The terminal portions 72 are secured to a rearward surface of a wear block 74. A forward surface of the wear block 74 acts as a wear plate 76. Due to the springiness of the arm portion between the wear block and the nut 64, the wear block is biased radially outwardly away from the shaft 22.

Figure 2:
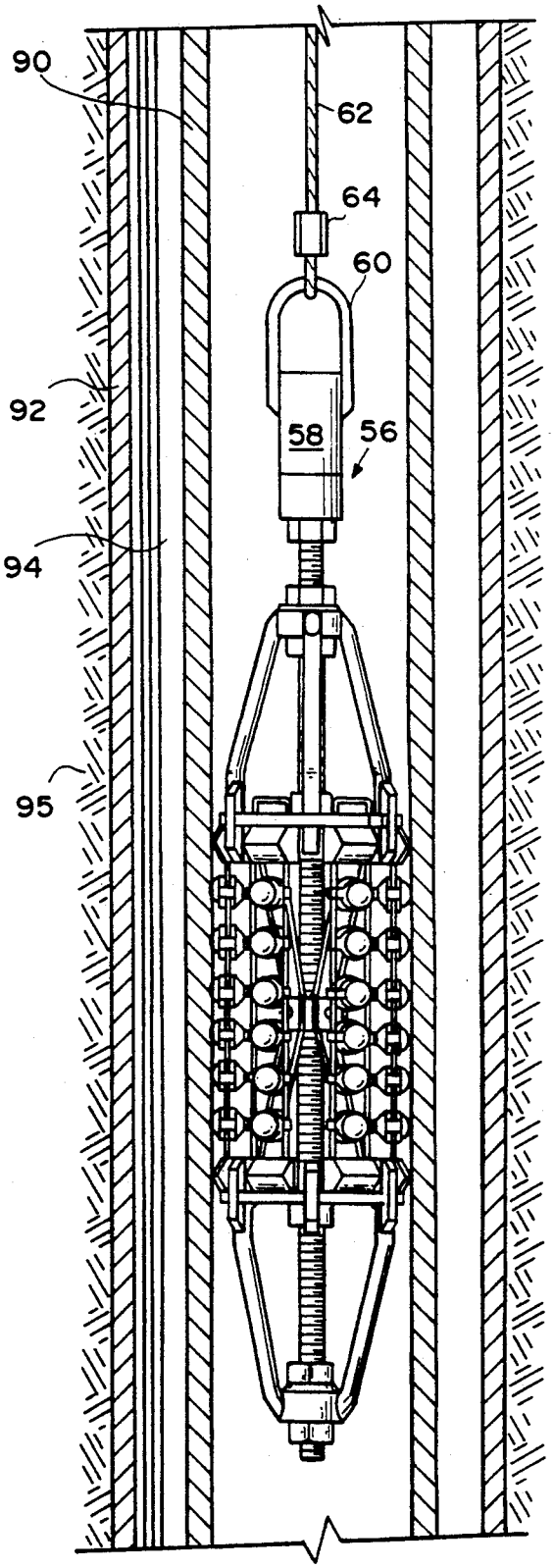
FIG. 2 illustrates the casing hole puncher located within a well pipe casing which is surrounded by a protection casing mounted in cement.

Extending downwardly through the six pairs of slots 78, in the disk 38, is a U-shaped biwire 80. The legs 82 of the biwire 80 pass downwardly through the slots 78 through aligned openings 84 in the wear block and continue downwardly to pass through apertures 84 which extend through opposite sides of explosive charges 86. In FIGS. 1 through 3, there are six perforating charges 86 located on each of the six biwires 80 with the six biwires spaced about the periphery of disk 38 at a separation of 60°.

The biwires after passing through the six charges 86 again pass through openings 84 of the lowermost wear block 72 and through corresponding slots 88 which are aligned with the pairs of slots 78 in the upper disk 38.

As shown in FIG. 2, the casing hole puncher is lowered through an innermost well pipe casing 90, which is concentrically located within a protection casing 92. An annular space 94 is located between the well pipe casing and protection casing 92. Surrounding the casing 92 is cement 95 for anchoring the well bore without escape of gases to the surface along the side of the well bore.

By the bias of the wear blocks mounted at the ends of the elongated spring member 68, the inner wall of the well bore casing 90 is contacted by the wear blocks 72. Depending upon the location of the openings 84 in the wear blocks, the separation distance between the face of the perforation charges 86 and the inner wall of the well bore casing can be adjusted. In the example shown in FIG. 2, the perforating charges 86 are mounted so that the face of the perforating charges is aligned so as to be in intimate contact with the inner wall of the well pipe casing.

Depending upon the amount of separation between the well pipe casing 90 and surrounding strings of pipes, typically surrounded by at least two additional strings of pipe, the number of strings of pipes which are to be punched or perforated is controlled. In FIG. 2, the location of the explosive charges in intimate contact with the pipe casing 90 provides for a punching of only the pipe casing 90 to form a defined hole without further damaging or causing fractures of the pipe casing 90. When the explosive charges 86 are backed away from the inner face of the pipe casing 90, depending upon the distance from the face of the inner surface of the pipe casing, the pipe casing will be penetrated along with adjacent strings of pipe. The holes produced in this instance will be more of a destructive force rather than a deformation force resulting from the intimate contact of the explosive charge with the inner face of the pipe casing 90.

As shown in FIG. 3, primer cord 96 is shown in dotted lines as representative of a standard mechanism for exploding the explosive charges from the surface. The primer cord 96 for each string of charges on a biwire 80 passes through the holes 98 in the upper disk 38.

Holes 98 in disk 38, as well as corresponding holes in the lower disk 28, allow well fluid to pass through the casing hole puncher to facilitate lowering of the casing hole puncher. In addition, any debris disturbed by the explosion of the explosive charges is also allowed to pass through these holes without affecting the casing hole puncher.

By the use of the casing hole puncher shown in FIGS. 1 through 3, it is possible to detonate 36 explosive charges per foot through the innermost string of a series of concentric strings without any damage to surrounding strings. The placement of the face of the perforating charge in intimate contact with the inner surface of the string 90 achieves this result.

By this method, the innermost string maintains its integrity with a hole being punched in the string without any loss of metal by the explosion. The steel string 90 is simply pushed back or deformed at the location of the charge without loss of any of the metal deformed by the charge. By this method, the casing integrity is maintained without fracture of the casing.

Cement is thereby able to be passed through the casing and into the annular space between the next adjacent string for a complete filling of the annular space about the innermost string so as to isolate one zone from another when control of the zones between the strings of casing is required or when a well bore is to be abandoned. In addition, there is no "channeling" between the strings which would allow communication between a lower zone and the surface.

All previous attempts on hole punching of the innermost string with decentralized charges located in contact with the inner wall of the innermost string have only allowed a maximum of six shots per foot at only one side of the string. By the present invention, it is possible to obtain a maximum of 36 shots per foot spaced about the circumference (360°) of the innermost string or any desired lesser number of shot density.

In FIGS. 7 through 10, a four-way decentralized casing hole puncher 100 is shown. In this embodiment, two one-foot sections 102 and 104 are shown mounted on a single shaft. In this embodiment, four charges are mounted on a single biwire 106 with four strings of charges being spaced circumferentially between an upper disk 108 and a central disk 110, and between central disk 110 and lower disk 112. Therefore, sixteen shots per foot are achieved.

In FIGS. 7 through 10, similar structure to that disclosed for FIGS. 1 through 6 has been labeled with the same reference numerals as in FIGS. 1 through 6 with a prime indication. The equivalent to hex nut 64 is a four-sided nut 114.

When the perforating charges 86 are recessed from the inner wall of the innermost string by approximately one inch, they act as a perforating charge to punch through the walls of the inner string and all surrounding strings so as to pass into the surrounding cement sheet and natural formation.

Having described the invention, many modifications thereto will become apparent to those skilled in the art to which it pertains without deviation from the spirit of the invention as defined by the scope of the appended claims.

I claim:

1. A decentralized casing hole puncher comprising:

a centrally located, solid shaft extending the entire length of the hole puncher, at least two spaced disks rotatably mounted on said shaft for changing of phasing, lock means for securing said disks to said shaft at a desired degree of phasing, mounting means extending between said at least two disks and spaced about a periphery of said at least two disks for mounting of explosive charges in contact with a periphery of an inner surface of a pipe string, spaced about the periphery, said mounting means providing for sliding movement of explosive charges so that the charges may be grouped tightly together to increase charge density or so that the changes may be spread apart to decrease charge density, and biasing means mounted on and extending from said shaft for biasing said mounting means radially outwardly and for moving explosive charges mounted in said mounting means in relation to the inner surface of the pipe string.

2. A decentralized casing hole puncher as claimed in claim 1, wherein said disks are of a diameter less than the inner diameter of the pipe string.

3. A decentralized casing hole puncher as claimed in claim 1, wherein said mounting means includes a biwire having two legs extending through the explosive charges.

4. A method of punching a hole in a pipe string, said method comprising:

loading explosive charges about a circumference of a carrier having a centrally located solid shaft extending the entire length of the hole puncher, at least two spaced disks rotatably mounted on said shaft for changing of phasing, lock means for securing said disks to said shaft at a desired degree of phasing, mounting means extending between said at least two disks and spaced about a periphery of said at least two disks for mounting of explosive charges in contact with a periphery of an inner surface of a pipe string, spaced about the periphery, said mounting means providing for sliding movement of explosive charges so that the charges may be grouped tightly together to increase charge density or so that the changes may be spread apart to decrease charge density, and biasing means mounted on and extending from said shaft for biasing said mounting means radially outwardly and for moving explosive charges mounted in said mounting means in relation to the inner surface of the pipe string, lowering the carrier into a pipe string to a desired depth, biasing the explosive charges with respect to an inner wall of the pipe string, and exploding the charges to punch holes spaced about 360° through the pipe string.

5. A method of punching a hole in a pipe string as claimed in claim 4, wherein the explosive charges are separated by 90°.

6. A method of punching a hole in a pipe string as claimed in claim 4, wherein the explosive charges are separated by 60°.

7. A method of punching a hole in a pipe string as claimed in claim 6, wherein the carrier contains an explosive charge density equal to or greater than six.

8. A method of punching a hole in a pipe string as claimed in claim 7, wherein the carrier contains an explosive charge density equal to or less than thirty-six.

9. A method of punching a hole in a pipe string as claimed in claim 5, wherein the carrier contains an explosive charge density equal to or greater than four.

10. A method of punching a hole in a pipe string as claimed in claim 9, wherein the carrier contains an explosive charge density equal to or less than sixteen.

* * * * *